United States Patent [19]

Facchini

[11] 4,341,244

[45] Jul. 27, 1982

[54] METERING DEVICE PARTICULARLY FOR CAPSULE-FILLING MACHINES

[75] Inventor: Libero Facchini, Bologna, Italy

[73] Assignee: Farmatic S.N.C., Bologna, Italy

[21] Appl. No.: 91,849

[22] Filed: Nov. 6, 1979

[30] Foreign Application Priority Data

Nov. 9, 1978 [IT] Italy ..... 84948 A/78

[51] Int. Cl.[3] ..... B65B 1/04

[52] U.S. Cl. ..... 141/18; 141/71; 141/258; 141/392; 141/286

[58] Field of Search .....141/67, 392, 159, 2 141/286, 18-29, 34, 12, 71-81, 258, 259, 260, 261, 262; 222/152

[56] References Cited

U.S. PATENT DOCUMENTS

| | | | |
|---|---|---|---|
| 3,468,095 | 9/1969 | Vogt | 141/59 |
| 3,656,517 | 4/1972 | Taylor et al. | 141/1 |
| 3,996,977 | 12/1976 | Hansel | 141/392 |

*Primary Examiner*—Houston S. Bell, Jr.
*Attorney, Agent, or Firm*—Karl F. Ross

[57] ABSTRACT

The invention relates to a metering device, particularly for capsule-filling machines. The device comprises a bowl having one or more chambers for receiving the product to be packaged. At least part of the bottom of the chambers is permeable to the air but impermeable to the product, and is arranged to communicate with a suction source.

1 Claim, 2 Drawing Figures

METERING DEVICE PARTICULARLY FOR CAPSULE-FILLING MACHINES

BACKGROUND OF THE INVENTION

The present invention relates to a metering device, particularly for capsule-filling machines. In conventional capsule-filling machines, the product to be packaged is picked up in doses from a rotating bowl by means of a metering unit and transferred into capsules. The capsules comprise a bottom and a cap made, for example, of hard gelatine. Before being filled with product, each capsule is opened, i.e. its cap is removed from the bottom and the latter is then ready to receive a dose of product coming from the metering device. The metering device usually comprises a punch member which is arranged to enter with its lower end a bowl of product and to fill a cavity formed in this end with product by the combined action of penetration of the punch member and of pressure against the product and thus against the bottom of the bowl.

Conventional metering devices, however, have the disadvantages that vacuum spots are created in the doses of products picked up by the punch member, the vacuum spots being caused by non-uniform arrangement and stratification of the product. This drawback is prejudicial to the obtainment of perfect metering as the metering punch member penetrates in a non-compact and homogeneus state, and thus it will pick up different amounts of product depending upon the stratification rate in the various zones of the product in the bowl. This undesired phenomenon is prejudicial to the possibility of conveniently processing and manipulating products which due to their nature have low flowability and difficult to give raise to stratification, as well as very bulky products which are liable to remain in suspension.

In conventional capsule-filling machines, the above mentioned kinds of products can be handled only by adding eccipient agents capable of giving the product particular and desired flowability and stratification characteristics that otherwise they would not possess. However, this operation often gives rise to a remarkable increase in volume of the dose of product to be loaded into single capsules and thus it is necessary to make use of capsules of larger sizes, to adopt supplementary mixing operations, possible granulation, which results in higher costs of production.

SUMMARY OF THE INVENTION

An object of the present invention is to provide a metering device capable of substantially eliminating the above mentioned drawbacks.

Another object of the present invention is to make possible to reduce the amount of product which is handled in the capsule-filling machine.

Another object of the present invention is to safely prevent the product from coming out of the bowl owing to centrifugal force due to rotational movement at high speed to which the bowl is subjected.

An important object of the present invention is to obtain high accuracy in the metering operation.

According to the invention there is provided a metering device particularly for capsule-filling machines for filling capsules with powder product, comprising a bowl containing the powder product and a volumetric metering unit consisting of a hollow punch designed to move between a raised position and a lower position inside said bowl for picking up a dose of product, wherein according to the improvement said bowl comprises at least one chamber formed in the bottom of said bowl and having a removable bottom element permeable to the air but impermeable to the powder product, said removable bottom defining a cavity communicating with a vacuum source.

BRIEF DESCRIPTION OF THE DRAWINGS

The invention is further explained below with reference to the accompanying drawings, in which.

DESCRIPTION OF THE PREFERRED EMBODIMENTS

Figure 1:
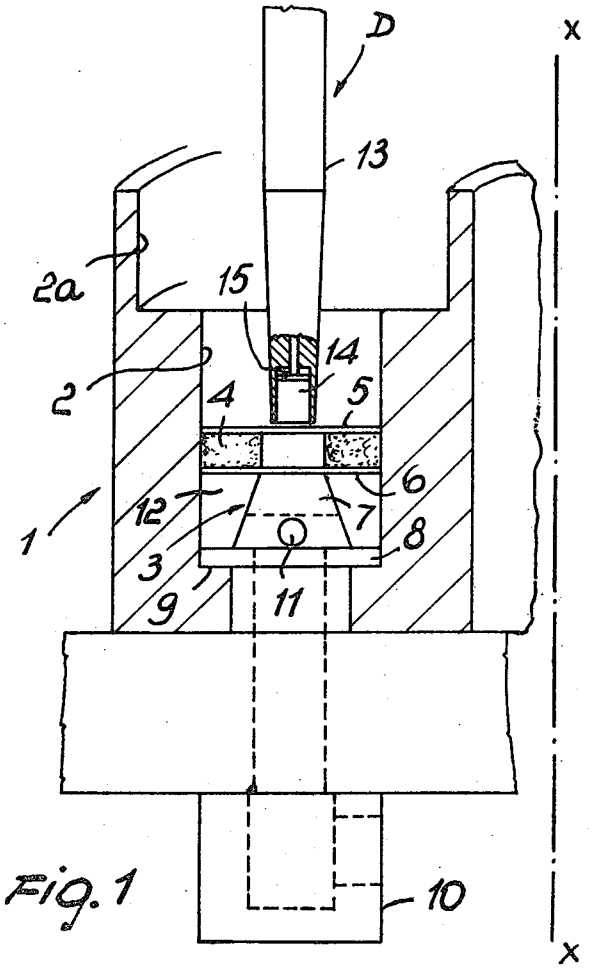
FIG. 1 is an elevational view with parts shown in cross section of a first embodiment of a metering device in accordance with the invention.

With reference to FIG. 1, the device comprises a bowl 1 in the bottom of which chambers 2 are provided which are fed with product by a trough 2*a* which circularly extends about an axis of rotation X—X of a capsule-filling machine on which the bowl is mounted. The depth of the chambers 2 can be varied by replacing a removable bottom element 3 which comprises a porous layer 4 (e.g. a felt element, or a sintered stainless steel element, which is permeable to the air but impermeable to the product and which is held in position by two perforated discs, i.e. an upper disc 5 and lower disc 6 of stainless steel. The discs 5 and 6 are fixed onto a frusto-conical support member 7 which terminates at its lower end with a flange 8 arranged to abut against the bottom 9 of the chamber 2 between the lower disc 6 and the flange 8 an annular cavity 12 is defined which surrounds the frusto-conical support member 10. The annular cavity 12 communicates with lides formed in the support member 7. The holes communicate with a vacuum source (not shown) through a connecting section 10 fixed to the structure of the capsule-filling machine. Owing to the suction action the powder product fed into the trough 2*a* is sucked into the chambers 2 and compacted against the upper disc 5 in order to be picked up by a volumetric metering unit D. Conventionally, the volumetric metering unit D comprises a hollow punch 13 which is designed to move downwardly and enter the chamber 2 and to raise a dose of product picked up from the chamber 2; the punch 13 has a cavity 14 in its lower end, whose volume may be varied by adjusting the position of a piston 15 which constitues the bottom of the cavity.

Figure 2:
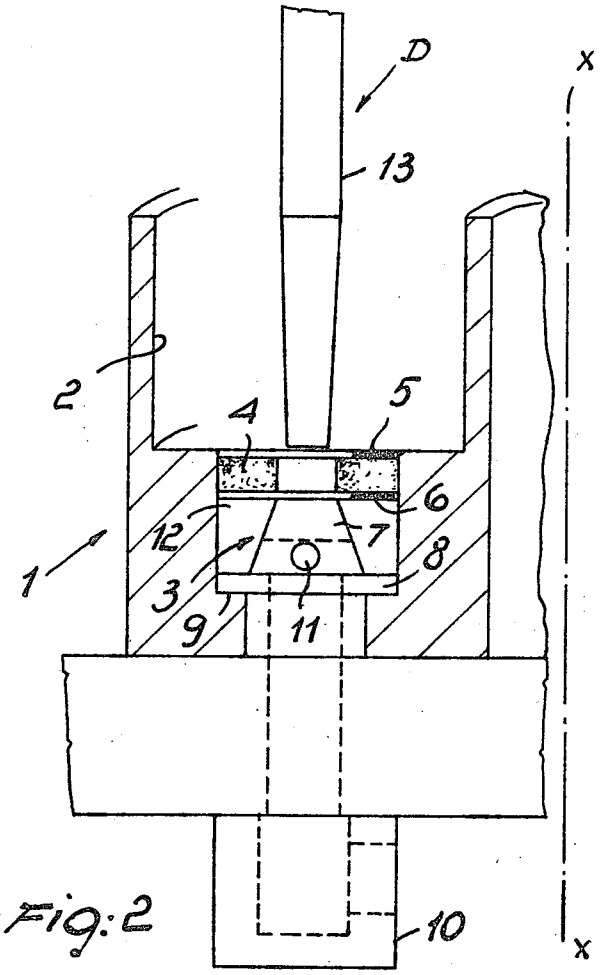
FIG. 2 is a view similar to FIG. 1 of a second embodiment of a metering device in accordance with the invention.

In the embodiment shown in FIG. 2 (in which elements equal or similar to those of FIG. 1 are indicated by the same reference numerals), the disc 5 of the bottom element 3 is at the same level as the bottom of the trough 2*a* which in this case also delimits a space from which the product is picked up. The embodiment shown in FIG. 2 is suitable for products having high flowability.

The above described bowl 1, thanks to the sucking effect, makes it possible to obtain perfect compacting of a predetermined amount of product, thereby solving the problem created by the vacuum spots due to failing or defective stratification of the product. In fact the product to be processed is caused to enter the chambers 2, the product being held by sucking effect during the picking up step performed by the volumetric metering unit D. An advantageous aspect of the bowl according to the invention is that, contrary to conventionally systems it requires a limited amount of product (such as about 1 kilogram against 9–10 kilograms required in same conventional machines).

Furthermore, the product cannot come out of the bowl owing to centrifugal force since the product is held in a sucked condition against the upper disc 5.

Another important advantage of the bowl in accordance with the invention is the very high metering accuracy that can be attained since the volumetric metering unit picks up product in a space where the product has already been precompacted.

I claim:

1. In a capsule-filling machine having a bowl adapted to receive a quantity of pulverulent material to be introduced into capsules, and a volumetric metering member in the form of a vertically displaceable plunger having a metering cavity at its lower end and adapted to be lowered into said bowl to pick up a quantity of said material, the improvement wherein said bowl comprises:

an upwardly open vessel rotatable about a vertical axis and formed with an annular cylindrical chamber opening upwardly and extending to the bottom of said chamber;

a removable insert replaceably received in said chamber and forming a fluid-permeable floor for said bowl impermeable to said material therein, said insert including:

an upper perforated metal plate defining said floor, a lower perforated metal plate spaced below said upper plate, a fluid-permeable filling between said plates, and a support extending to said bottom of said chamber and carrying said plates and said filling while maintaining an annular fluid-distributing compartment in said chamber communicating with said filling and the perforations in said plates; and means for connecting said compartment with a suction source.

* * * * *